US005195676A

United States Patent [19]

LeBras

[11] Patent Number: 5,195,676

[45] Date of Patent: Mar. 23, 1993

[54] CARTON FOR CANS

[75] Inventor: Philippe LeBras, Chateauroux, France

[73] Assignee: The Mead Corporation, Dayton, Ohio

[21] Appl. No.: 869,404

[22] Filed: Apr. 16, 1992

[30] Foreign Application Priority Data

Apr. 16, 1991 [GB] United Kingdom ..... 9108057

[51] Int. Cl.[5] ..... B65D 65/22

[52] U.S. Cl. ..... 229/40; 206/427; 229/198.2

[58] Field of Search ..... 229/40, 198.2; 206/140, 206/427

[56] References Cited

U.S. PATENT DOCUMENTS

| | | | |
|---|---|---|---|
| 3,640,448 | 2/1972 | Wood | 229/40 |
| 4,202,446 | 5/1980 | Sutherland | 229/40 |
| 4,295,598 | 10/1981 | Calvert | 229/40 |
| 4,394,903 | 7/1983 | Bakx | 229/40 |
| 4,440,340 | 4/1984 | Bakx | 206/140 |
| 4,597,523 | 7/1986 | Schuster | 229/40 |
| 4,744,507 | 5/1988 | Morsbach | 229/40 |
| 4,925,019 | 5/1990 | Ganz et al. | 206/427 |
| 5,000,313 | 3/1991 | Oliff | 229/40 |
| 5,131,588 | 7/1992 | Oliff | 229/40 |

*Primary Examiner*—Gary E. Elkins
*Attorney, Agent, or Firm*—Erwin Doerr

[57] ABSTRACT

A carton blank (10) comprises hingably interconnected main panels (12,30,32,34) and a corner gusset structure (50,51) section hingably connected to two adjacent main panels (12,30). One of the main panels (12) has a fold line (20) which lies substantially parallel to the hinged connection (22) between the adjacent two panels. The fold line defines two panel portions (12,12*a*) in the main panel (12) which can be displaced from coplanar alignment with one another about the fold line (20) during formation of a carton in order to facilitate formation of the corner gusset structure.

5 Claims, 3 Drawing Sheets

CARTON FOR CANS

The invention relates to a carton which comprises a blank for forming about at least one row of articles, more particularly, beverage cans.

Wrap-around type carton blanks commonly comprise foldably inter-connected upper, side and base panels and often include subsidiary 'shoulder' panels or bevel strips as they are known in the art which are substantially smaller than the aforementioned main panels and which are disposed between any two of the main panels. Additionally, such carton blanks may incorporate corner gusset structures which act to reinforce a corner section and/or provide article retention elements at the ends of a carton sleeve. Corner gussets can be formed from two panel sections which are foldably joined together and in which each panel section is foldably joined to one of two adjacent panels to be folded relative to one another.

Known cartons incorporate gusset structures which are erected during the formation and loading process of the carton. The cartons to which the invention relates are usually made substantially of a single blank of paperboard or like material which is cut and scored and/or creased according to the desired shape and size of the final carton. Main fold lines are provided along parts of the carton blank which will constitute a corner edge when the carton is formed, that is, the fold lines enable the blank to be folded along the fold lines and the panel sections of the blank on each side of the fold line remain relatively displaced, that is non-coplanar, once the carton is formed and thus an edge in the carton is created along that fold line.

In addition to the simple type of gusset structure in a carton blank described above, it is also known to provide an end closure structure foldably joined to the corner gusset structure and to an adjacent one of the main panels of the carton.

In the carton of the present invention a 'subsidiary side panel' presents a sloping panel or bevel strip to conform with the inwardly recessed configuration of the can tops. This bevel strip, in conjunction with the gusset structures associated therewith renders formation of the gusset structure difficult. Of course, without the bevel strip interposed between the top and side walls, the formation of the gusset structures would be relatively straightforward and accomplished by folding the side wall flaps inwardly as the side wall panels are folded downwardly about single fold lines between the top and side walls as is customary in the art.

The present invention seeks to facilitate the formation of a carton comprising gusset sections and bevel strips interposed between the top and side walls of the carton and to provide a carton adapted to be manipulated with relative ease.

One aspect of the present invention provides a carton blank comprising hingably interconnected main panels and a corner gusset structure section hingably connect to two adjacent main panels, wherein one of the adjacent main panels comprises a fold line which lies substantially parallel to the hinged connection between the adjacent two panels, characterized in that said fold line defines two panel portions in said one adjacent main panel which panel portions can be displaced from coplanar alignment with one another about said fold line during formation of a carton in order to facilitate formation of said corner gusset structure.

According to a feature of this aspect of the invention the other of said adjacent main panels may comprise a bevel strip which is connected to said hinged connection which connects together the adjacent two main panels.

According to another feature of this aspect of the invention the other of said adjacent main panels may comprise a panel flap which is hingable about a fold line substantially perpendicular to the hinge which joins the adjacent panels and which panel flap is hingably connected to the gusset structure. Preferably, the gusset structure comprises a first and second portion, the first gusset portion being hingably connected to the side of the one adjacent panel between the hinge which connects the adjacent main panels and the fold line, and wherein the second gusset portion is hingably connected to the panel flaps.

According to a still further feature of this aspect of the invention said fold line may enable rotation of the panel portion which is joined to said hinged connection which joins the adjacent main panels to be rotated outwardly from the other panel portion relative to the inside of the completed carton. Preferably, the fold line is relatively longer than the hinge which joins the two adjacent panels.

Another aspect of the invention provides a carton blank comprising hingably interconnected main panels comprising top panel, bottom panel, and a pair of side panels, for forming a wraparound carton, gusset structures hingably connected to pairs of adjacent main panels, one gusset structure at each end of each hinge which connects the main top, bottom and side panels, a pair of top panel fold lines in the top panel which are spaced from, but substantially parallel to, respective one of the hinges which join the top panel to the side panels, side panels each comprising a hingable bevel strip and having attached thereto a hingable flap panel, one flap panel at each end of the side panel wherein said flap panels are further hingably connected to the gusset structures between the side panel and the top panel and the side panel and the bottom panel.

Yet another aspect of the present invention provides a method of forming a carton from a blank which blank comprises hingably interconnected main panels and a corner gusset structure section hingably connected to two adjacent main panels, wherein one of the adjacent main panels comprises a fold line which lies substantially parallel to the hinged connection between the adjacent two panels and which fold line defines a panel portion between said fold line and said hinged connection, said method comprising the steps of rotating said panel portion outwardly, relative to the internal faces of the completed carton, about said fold line, setting up said gusset structures by folding relative to said main panels and rotating said panel portion in the opposite direction.

The invention will now be described, by way of example only, with reference to the accompanying drawings in which.

Figure 1:
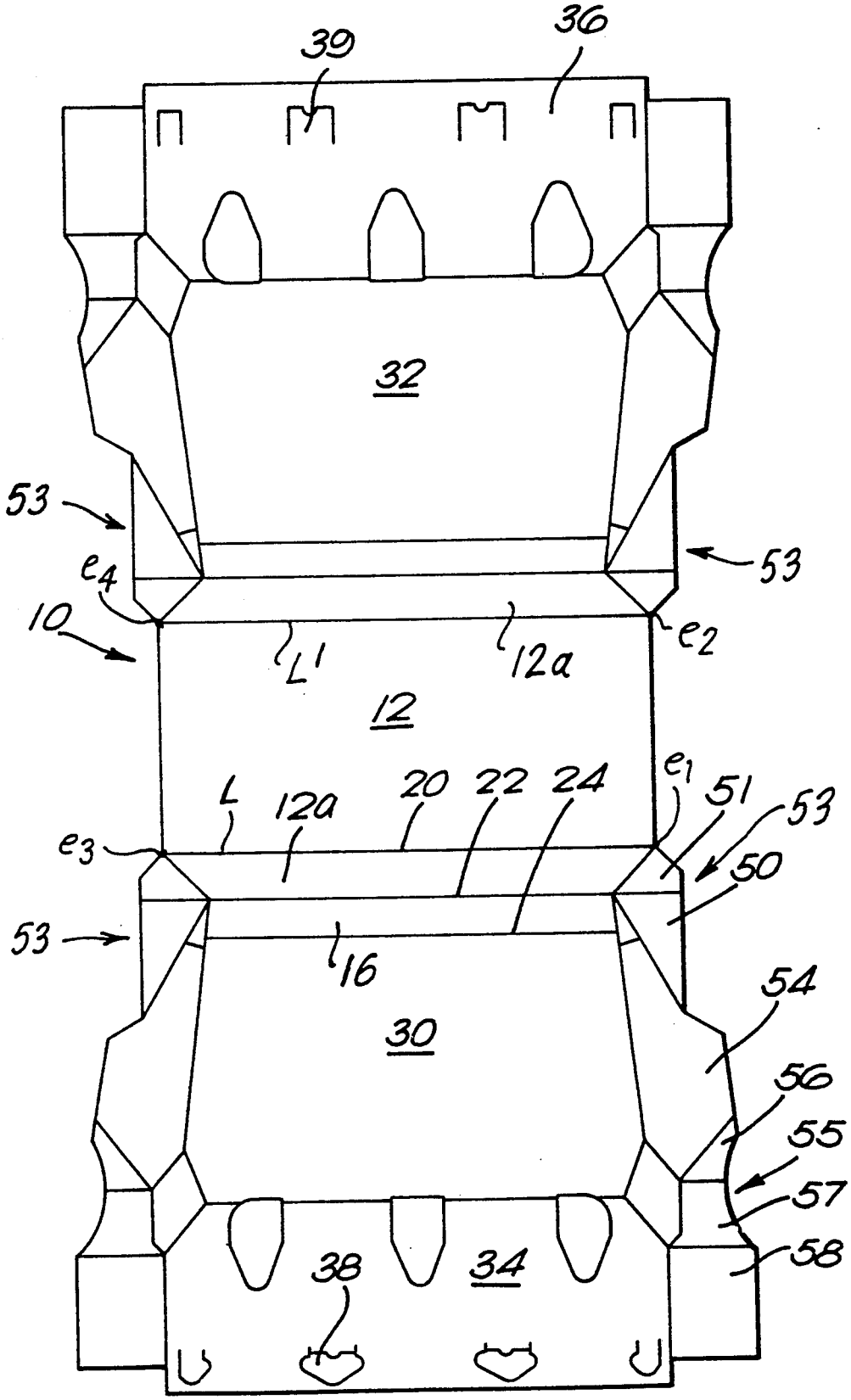
FIG. 1 shows a plan elevation of an embodiment of a blank for forming a carton according to the invention.
Figure 2:
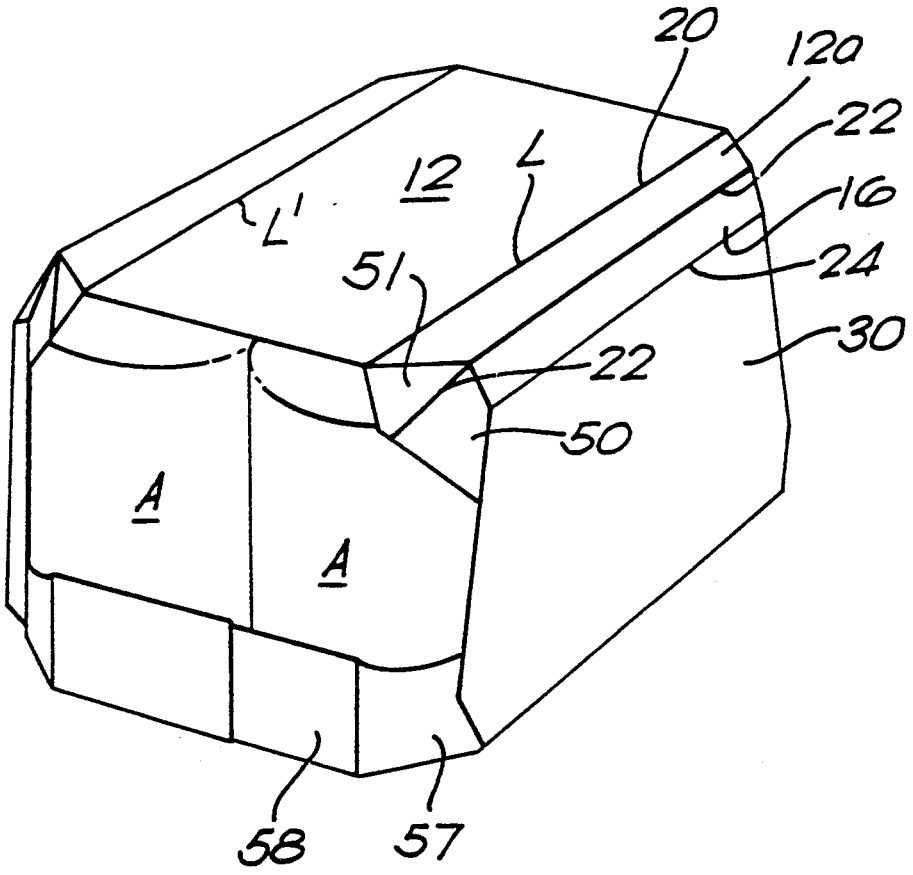
FIG. 2 is a perspective view of a carton as seen from one end when formed from the blank shown in FIG. 1.

The carton shown in FIGS. 1, 2, 3 and 4 comprises a blank 10 which is designed to be wrapped about a group of articles, such as cans, and provide a means for securing the cans so that they can be sold as a unit and easily carried. A view of the completed carton shown in FIG. 2 depicts the blank after having been formed into a carton carrying two rows of cans A. The elongate carton blank 10 comprises foldably connected top panel 12, side panels 30 and 32 and base panels 34 and 36.

The blank is formed from a single sheet of paperboard or like foldable sheet material the opposite end panels of which are adapted to form a base and are secured in overlapping relationship by known locking tabs 38 provided in one of the base panels 34 which are inserted in openings 39 defined by retaining tabs provided in the other base panel 36.

The carton blank shown in the Figures also comprises four similar corner gussets 53 each of which comprise both of a pair of mutually hinged triangular and quadrilateral flaps 50 and 51 respectively. Since the carton is of symmetrical form only one set of the corner gusset, side and base panel flap will be described, it being understood that like constructions are also present elsewhere in the carton blank as can be seen in the drawings. Flap 51 is hinged to the top panel 12 and flap 50 is hinged to a side panel flap 54. Side panel flap 54 is hinged to side panel 30 and assists in the formation of a corner gusset when the blank is being folded into the formed carton. By folding the side panel flap 54 flat against the internal face of the side panel 30 the corner gusset 53 is forced into the desired three dimensional shape required to add strength to the top corner of the carton as well as acting to retain the packaged cans A, as shown in FIG. 2, in addition to the bottom corner gussets 55. The carton blank further comprises lower corner panel 55 which itself comprises corner flaps 56 and 57 and a lower end closure panel 58 hinged together in series. Flap 56 is hinged to side wall flap 54 and flap 57 is hinged to lower end panel 58 which in turn is hinged to base panel 34. In the formed carton shown in FIG. 2 the lower corner sections are manipulated and together with the lower end closure panels act partially to close the ends of the sleeve and to reinforce the carton.

As best seen in FIG. 1 there is shown a transverse fold line 22 which hinges together top panel 12 and side wall panel 30. Fold line 22 extends into corner gusset 53 to provide the hinge between flaps 50 and 51. A parallel spaced fold line 20 is formed in the top panel 12 in order to facilitate formation of the corner gusset 53. Top panel 12 is thus sectioned into a main panel portion and subsidiary panel portions **12*a* connected by fold line 20. Thus the transverse fold line 22 forms a top edge in the formed carton as shown in FIG. 2**.

Side panel 30 comprises main panel and subsidiary panel 16 hinged together by fold line 24. In the formed carton, panel 16 forms a sloping shoulder panel between main side panel 30 and top panel 12. Panel 16 creates a carton shape which matches a certain profile or the contours of cans which have cylindrical side walls and inwardly tapered recessed bottom and top portions, canned soft drinks for example. Panel 16 is also referred to as a bevel panel and is further described in U.S. Pat. No. 5,000,313, the teachings of which are incorporated herein by reference.

Temporary folding of the blank about fold line 20 takes panel 12 and **12*a* out of coplanar alignment. Such temporary folding is used in the carton forming process and assists in the current forming and position of gussets 53**.

Figure 3:
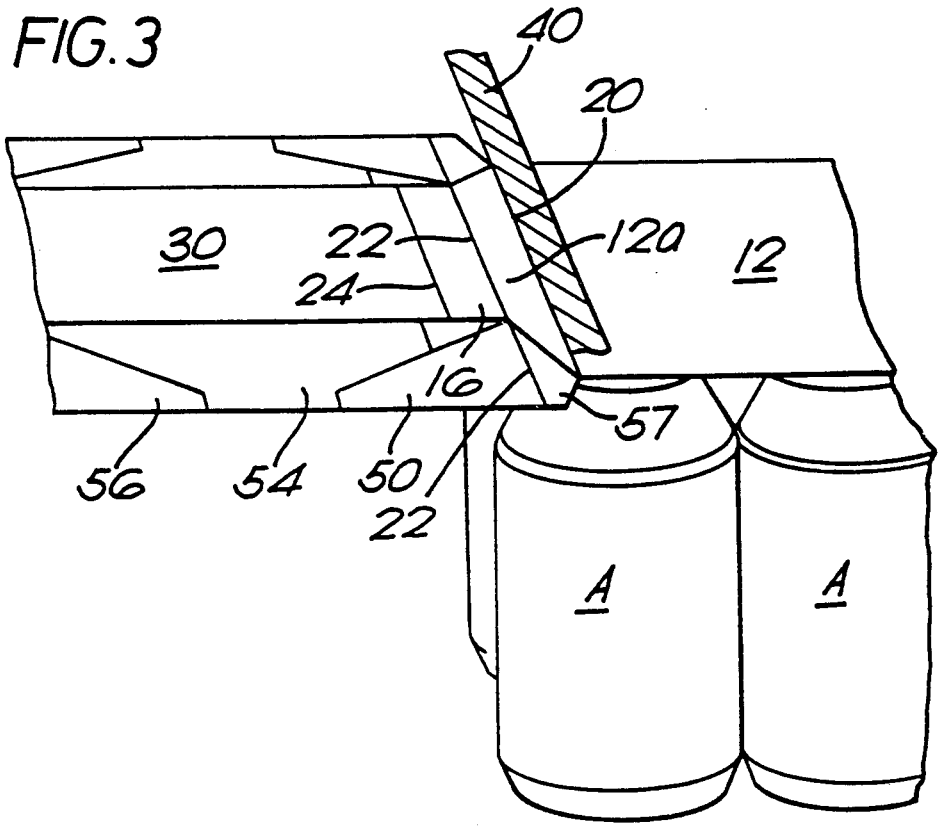
FIG. 3 is a perspective view of the blank and articles to be packaged during the wrap-around carton formation process.
Figure 4:
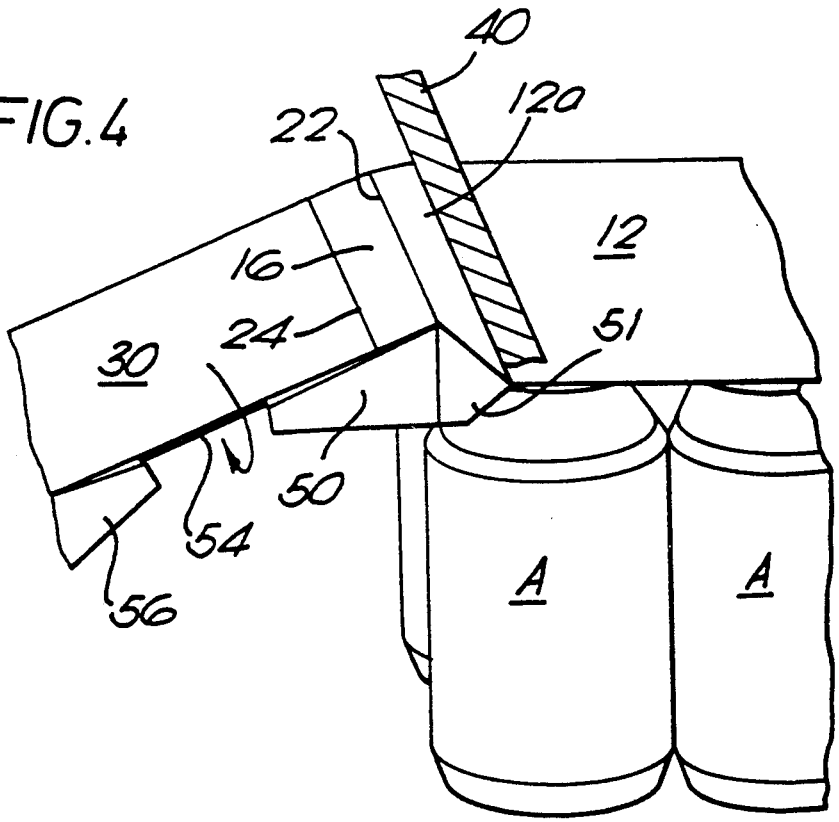
FIG. 4 is a perspective view of the blank and articles to be packaged during a later stage of formation.

FIGS. 3 and 4 show partial perspective views of the carton during formation in which a holding bar 40 is applied to the top panel to extend along fold line 20 and to prevent movement of the top panel with respect to the articles A. Holding bar 40, assists in folding of the carton panels relative to the top panel. In FIG. 3 the holding bar is shown aligned along fold 20. The remaining side panel 30 and associated base panel 34 of the blank are raised causing relative bending motion about fold line 20. This motion causes rotation of the subsidiary top panel **12*a* about an axis defined by the fold 20, with respect to the rest of the top panel 12. This enables a relatively straightforward formation of corner gusset 53 when the side panel flap 54, is internally tucked against the associated side panel as shown in FIG. 4. Side panel 30 is then lowered by hinging about fold lines 22 and 24 until it abuts the sides of articles A. When the carton is formed the top panel and side panels are approximately at right angles and fold line 22 forms the top corner edge of the carton. Top panel 12 and subsidiary panel 12*a* form the top face of the carton and no permanent edging is formed along fold line 20 in the carton as shown in FIG. 2 although permanent edging does result from the final positions of fold lines 22 and 24**.

As shown in FIGS. 3 and 4 the fold line 20 thus facilitates partial formation of a corner gusset 53 before the side panel flap 54 is used fully to form the gusset. This substantially eases the formation of the gusset and helps prevent buckling of carton panels or the formation of unwanted creases in the carton blank which might otherwise occur as the gusset is forced into its required set-up position.

I claim:

1. A carton blank comprising:

main panels hingedly connected along hinged connections and comprising a top panel, a bottom panel, and a pair of side panels for forming a wrap-around carton;

gusset structures hingably connected to pairs of adjacent ones of said main panels, one said gusset structure at each end of each of said hinged connections which connect said main top, bottom and side panels;

a pair of top panel fold lines in said top panel which are spaced from, but substantially parallel to, respective ones of said hinged connections which join said top panel to said side panels;

said side panels each including hingable bevel strips and hingable flap panels, one of said flap panels at each end of said side panel wherein said flap panels are further hingably connected to said gusset structures at the respective end of said side panel between said side panel and said top panel and said side panel and said bottom panel.

2. A carton blank comprising:

main panels (12,30) interconnected along a hinged connection (22), a corner gusset structure (53) hingedly connected to two adjacent ones of said main panels, one of the adjacent main panels comprising a first fold line (20) which lies substantially parallel to the hinged connection between the adjacent two main panels, said other of said adjacent main panels (30) including a bevel strip (16) which is connected to said hinged connection, said first fold line (20) defining two panel portions (12*a*) in said one adjacent main panel (12) whereby said panel portions can be displaced from coplanar alignment with one another about said first fold line (20) during formation of a carton in order to facilitate formation of said corner gusset structure.

3. A carton blank as claimed in claim 2, further comprising a panel flap (54) foldably joined to said other (30) of said adjacent main panels along a second fold line which is substantially perpendicular to said hinged connection (22), said panel flap being hingedly connected to said gusset structure (53).

4. A carton blank as claimed in claim 3 wherein said gusset structure comprises a first and second gusset portion (51,50), said first gusset portion (51) being hingedly connected to said one of said adjacent main panels between said hinged connection (22) and said first fold line (22), and wherein said second gusset portion (50) is hingedly connected to said panel flap (54).

5. A carton blank as claimed in claim 2 wherein said first fold line (20) is relatively longer than said hinged connection (22) between said two adjacent main panels (12,30).

* * * * *